US006030331A

United States Patent [19]

Zander

[11] Patent Number: 6,030,331

[45] Date of Patent: Feb. 29, 2000

[54] STACK OF FOLDER WET WIPES HAVING IMPROVED DISPENSABILITY AND A METHOD OF MAKING THE SAME

[75] Inventor: Teresa Marie Zander, Appleton, Wis.

[73] Assignee: Kimberly-Clark Worldwide, Inc., Neenah, Wis.

[21] Appl. No.: 09/329,741

[22] Filed: Jun. 10, 1999

Related U.S. Application Data

[62] Division of application No. 08/599,362, Mar. 15, 1996, Pat. No. 5,964,351.

[51] Int. Cl.[7] ..... B31F 1/08

[52] U.S. Cl. ..... 493/356; 428/126

[58] Field of Search ..... 428/126; 206/494; 493/357, 356; 221/48, 47, 50

[56] References Cited

U.S. PATENT DOCUMENTS

| | | | |
|---|---|---|---|
| 1,177,466 | 3/1916 | Winter | 221/47 |
| 2,020,668 | 11/1935 | Wandel | 154/2 |
| 3,784,056 | 1/1974 | Spruyt et al. | 221/63 |
| 3,841,466 | 10/1974 | Hoffman et al. | 206/205 |
| 4,100,324 | 7/1978 | Anderson et al. | 428/288 |
| 4,416,376 | 11/1983 | Scheffers et al. | 206/554 |
| 4,580,695 | 4/1986 | Lum | 221/52 |
| 4,848,575 | 7/1989 | Nakamura et al. | 206/449 |
| 5,309,828 | 5/1994 | Merry | 100/35 |
| 5,332,118 | 7/1994 | Muckenfuhs | 221/48 |
| 5,368,188 | 11/1994 | Twardowski | 221/50 |
| 5,540,332 | 7/1996 | Kopacz et al. | 206/494 |
| 5,565,258 | 10/1996 | McConnell et al. | 428/122 |

*Primary Examiner*—Alexander Thomas
*Attorney, Agent, or Firm*—Brian Paul; Gregory E. Croft

[57] ABSTRACT

A substantially rectangular stack of folded wet wipes having an improved dispensability and a method of producing the same are described. The stack of folded wet wipes includes a plurality of wet wipes which are individually folded and arranged in a stacked configuration. Each wet wipe includes a leading end edge which is folded about a fold line. The location of the leading end edge of each wet wipe is selectively varied throughout the stack of wet wipes to provide a more stable stack of wet wipes which has a substantially planar top surface.

9 Claims, 5 Drawing Sheets

STACK OF FOLDER WET WIPES HAVING IMPROVED DISPENSABILITY AND A METHOD OF MAKING THE SAME

This application is a divisional of application Ser. No. 08/599,362 entitled STACK OF FOLDED WET WIPES HAVING IMPROVED DISPENSABILITY AND A METHOD OF MAKING THE SAME and filed in the U.S. Patent and Trademark Office on Mar. 15, 1996, U.S. Pat. No. 5,964,351. The entirety of application Ser. No. 08/599,362 is hereby incorporated by reference.

BACKGROUND OF THE INVENTION

1. Field of the Invention

The present invention relates to a stack of folded wet wipes which are arranged to provide improved dispensability and stability. The invention particularly concerns a substantially rectangular stack of folded wet wipes which has a substantially planar top surface which allows the consumer to more easily grasp the leading end edge of the top wet wipe.

2. Description of the Related Art

Wet wipes are well known commercial consumer products which have been available in many forms. Perhaps the most common form of wet wipes has been a stack of moistened sheets which have been packaged in a plastic container. The wet wipes have been made from a variety of materials which have been moistened with a variety of suitable wiping solutions. Typically, the wet wipes have been available in either folded or unfolded configurations. For example, stacks of wet wipes have been available wherein each of the wet wipes in the stack has been arranged in a folded configuration such as a c-folded, z-folded or quarter-folded configuration as are well known to those skilled in the art. Each folded wet wipe has also been interfolded with the wet wipes immediately above and below in the stack of wet wipes. In an alternative configuration, the wet wipes have been in the form of continuous webs of material which include perforations to separate the individual wet wipes and which are wound into rolls and packaged in plastic containers. Such wet wipes have been used for baby wipes, hand wipes, household cleaning wipes, industrial wipes and the like.

The conventional packages which contain stacks of wet wipes, such as those described above, have been designed to provide one at a time dispensing which can be accomplished using a single hand. Such single handed, one at a time dispensing is particularly desirable because the other hand of the user is typically required to be simultaneously used for other functions. For example, when changing a diaper product on an infant, the user typically uses one hand to hold and maintain the infant in a desired position while the other hand is removing the product and searching for a wet wipe, such as a baby wipe, to clean the infant.

However, the dispensing of wet wipes which have been folded and arranged in such stacks has not been completely satisfactory. For example, users of the wet wipes have had difficulties recognizing and grasping the edges of each individual wet wipe to dispense or remove the wet wipe from the package. Typically, the individual wet wipes in the stack are folded such that the leading edge of each wet wipe is folded over upon another portion of the wet wipe. In use, the user will frictionally drag from one to three fingers across the top surface of the stack of wet wipes in an attempt to peelingly lift the leading end edge of the top wet wipe from the stack of wet wipes. However, the leading end edge of each wet wipe in such a folded configuration has tended to have an affinity for the other portions of the wet wipe especially when the wet wipes have been arranged in a stacked configuration for a period of time.

Moreover, the end edges of successive folded wet wipes in such stacks have typically been arranged in a vertical alignment, one on top of the other. Such alignment of the end edges of successive wet wipes has undesirably resulted in a recess or ridge at or near the end edges of each wet wipe due to the material thickness differences in the stack. A recess has been particularly evident in stacks of z-folded wet wipes which are arranged to provide a gap between the leading and trailing end edges of each wet wipe. Whereas, a ridge has been particularly evident in stacks of z-folded wet wipes which are arranged to provide an overlap between the leading and trailing end edges of each wet wipe.. The recess or ridge has resulted in stacks which have a nonplanar top surface which have not been aesthetically pleasing to the consumer. Typically, the leading end edge of the top wet wipe in the stack of wet wipes is located in or on the recess or ridge. As a result, in use, it has been undesirably difficult for the user to locate and peelingly lift the leading end edge of each wet wipe from the other portions of the wet wipe to facilitate the dispensing of each wet wipe from the stack of wet wipes.

The difficulties encountered in dispensing the wet wipes has been particularly evident in stacks of wet wipes which have a greater amount of solution and in stacks of wet wipes which have a greater number of wet wipes. For example, each wet wipe and, in particular, the edges of each wet wipe have had an increased affinity for the other portions of the wet wipe and the adjacent wet wipe in the stack as the amount of solution in the stack has increased. Moreover, as the number of wet wipes in the stack has increased, the size of the recess or ridge in the stack due to the location of the folded over end edges has also undesirably increased making it more difficult for the user to locate and grasp the leading end edge of the top wet wipe with one hand to dispense the wet wipe. Accordingly, it remains desirable to provide a stack of folded wet wipes which has a planar top surface without a ridge or recess to provide improved dispensability and stability of the wet wipes.

Generally, it is also desirable that the dimensions of each wet wipe in the stack are substantially identical to provide a substantially rectangular, stable stack which is easier to package and more aesthetically pleasing. However, the control of the dimensions of each wet wipe in many conventional stacks of wet wipes, such as those described above, has not been completely satisfactory. For example, many conventional stacks of wet wipes have included wet wipes which have variable, folded and unfolded length and width dimensions. Such variable dimensions have resulted in stacks which are skewed and unstable. Thus, it also remains desirable to control the manufacturing of the wet wipes such that the dimensions of each wet wipe, such as the total unfolded width, folded width, and location of the fold line or fold lines, in the stack are substantially constant to provide a more stable and aesthetically pleasing stack.

SUMMARY OF THE INVENTION

In response to the difficulties and problems discussed above, a new stack of folded wet wipes which has improved dispensability and stability and a method of producing the same have been discovered.

In one aspect, the present invention relates to a stack of wet wipes which comprises a plurality of individually folded wet wipes arranged in a substantially rectangular, stacked configuration. Each of the wet wipes defines a an unfolded width, a folded width and a top flap length. The unfolded width of the wet wipes in the stack defines a standard deviation of less than about 2.5 millimeters, the folded width of the wet wipes in the stack defines a standard deviation of less than about 2.5 millimeters, and the top flap length of the wet wipes is selectively varied throughout the stack to define a standard deviation of at least about 3.0 millimeters for the stack. In a particular embodiment, the top flap length of the wet wipes defines a standard deviation of at least about 4.0 millimeters.

In another aspect, the present invention relates to a stack of wet wipes comprising at least about 20 wet wipes which contain a liquid and which are individually z-folded and arranged in a stacked configuration. Each of the wet wipes defines a central portion, a top flap portion which is connected to and folded over upon the central portion along a first fold line, and a bottom flap portion which is connected to and folded under the central portion along a second fold line such that a gap exists between a leading end edge and a trailing end edge of the wet wipe. The wet wipes in the stack define an average gap distance of at least about 1.5 millimeters. A distance from a side margin of the stack of wet wipes to the leading end edge of the wet wipes is selectively varied throughout the stack to define a standard deviation of at least about 4.0 millimeters.

In still another aspect, the present invention relates to a method for providing a stack of individually folded wet wipes. The method comprises: (a) providing a continuously moving web of material; (b) folding the web of material along a first fold line to define a central portion and a top flap portion which includes a leading end edge which is folded over upon the central portion; (c) cutting the folded web of material to provide a plurality of generally rectangular, folded over wet wipes which define an unfolded width, a folded width, and a top flap length; and (d) arranging each of the folded over wet wipes in a substantially rectangular, stacked configuration to form the stack of wet wipes. The unfolded width of the wet wipes in the stack defines a standard deviation of less than about 2.5 millimeters and the folded width of the wet wipes in the stack defines a standard deviation of less than about 2.5 millimeters. The folding is also controlled to selectively vary the top flap length of the wet wipes throughout the stack such that the top flap length defines a standard deviation of at least about 3.0 millimeters for the stack.

In another aspect, the present invention relates to a method for providing a substantially rectangular stack of z-folded wet wipes which are easily dispensed. The method comprises the steps of: (a) providing a continuously moving web of material; b) adding a liquid to the web of material; (c) slitting the web of material in a machine direction into a plurality of continuously moving ribbons of material; (d) folding each of the ribbons of material along a first fold line and a second fold line to define a plurality of continuously moving z-folded ribbons which include a central portion, a top flap portion which is connected to and folded over upon the central portion along the first fold line, and a bottom flap portion which is connected to and folded under the central portion along the second fold line; e) arranging each of the continuously moving z-folded ribbons in a stacked configuration to provide a continuously moving stack of z-folded ribbons; (f) intermittently cutting the continuously moving stack of z-folded ribbons to provide a substack of z-folded wet wipes; and (g) combining a plurality of the substacks of z-folded wet wipes to provide the stack of z-folded wet wipes. The folding of each of the ribbons of material is controlled to selectively vary a length of the top flap portion on each of the ribbons. The folding and cutting are also controlled such that an unfolded width of the wet wipes defines a standard deviation of less than about 2.5 millimeters, a folded width of the wet wipes defines a standard deviation of less than about 2.5 millimeters, and the top flap length of the wet wipes is selectively varied throughout the stack to define a standard deviation of at least about 3.0 millimeters for the stack of wet wipes.

The present invention, in its various aspects, advantageously relates to a stack of folded wet wipes which, when compared to conventional stacks of wet wipes, has more consistent and reliable dispensing. In particular, the present invention provides a stack of folded wet wipes which has a substantially rectangular configuration with planar side margins and a planar top surface thereby allowing the user to easily locate and peelingly lift the leading end edges of the wet wipes to facilitate the dispensing or removal of each wet wipe from the stack. Thus, the present invention provides a stable, aesthetically pleasing stack of folded wet wipes which is configured such that the user is better able to use only a single hand to remove an individual wet wipe for use.

BRIEF DESCRIPTION OF THE DRAWINGS

The present invention will be more fully understood and further advantages will become apparent when reference is made to the following detailed description of the invention and the accompanying drawings. The drawings are merely representative and are not intended to limit the scope of the claims.

DETAILED DESCRIPTION OF THE INVENTION

The present invention relates to a stack of folded wet wipes which has improved dispensability and stability and a method of making the same. In addition, the present invention provides a package which contains the stack of wet wipes. The stack of folded wet wipes of the present invention can be used for baby wipes, hand wipes, face wipes, cosmetic wipes, household wipes, industrial wipes and the like.

As used herein, the term "stack" and "stacked configuration" refers to any collection of wet wipes wherein there is a plurality of surface-to-surface interfaces between the wet wipes.

Figure 1:
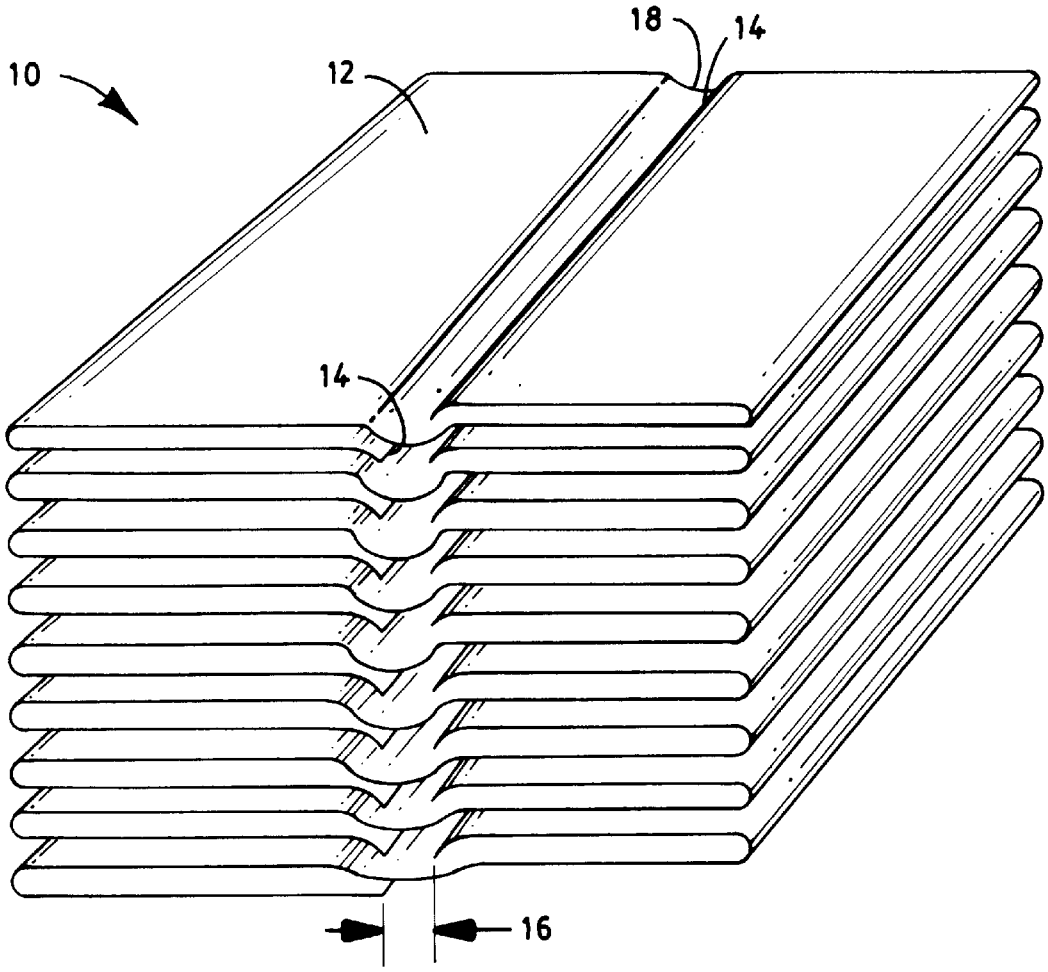
FIG. 1 representatively shows a perspective view of an example of a conventional stack of z-folded wet wipes wherein the leading end edges are vertically aligned one on top of the other in the stack.

Conventional stacks of folded wet wipes have typically been configured such that the end edges of the folded wet wipes are arranged in a vertical alignment, one on top of the other. FIG. 1 representatively illustrates an example of a conventional stack of folded wet wipes which is generally indicated at 10. The illustrated conventional stack of folded wet wipes 10 includes a plurality of individually folded wet wipes 12 which have been arranged in a z-folded configuration. The end edges 14 of the wet wipes have been arranged in a vertical alignment which has undesirably resulted in an area of recess 18 in the stack 10. The recess 18, as representatively illustrated in FIG. 1, has been particularly evident in stacks of z-folded wet wipes which are arranged to provide a gap between the leading and trailing end edges of each wet wipe. Alternatively, a ridge has undesirably formed in conventional stacks wherein the end edges of each wet wipe are configured to overlap.

The recess 18 or ridge on such conventional stacks has resulted in a stack having a nonplanar top surface which is not stable or aesthetically pleasing to the consumer. The recess or ridge has also adversely affected the dispensing of the wet wipes from the stack. Frequently, the leading end edge 14 of the top wet wipe 12 in the stack of wet wipes 10 has been located in the recess 18. As a result, in use, it has been undesirably difficult for the user to locate and peelingly lift the leading end edge 14 of each wet wipe from the other portions of the wet wipe to facilitate the dispensing of each wet wipe from such conventional stacks of wet wipes 10. The depth of the recess 18 has also increased as the number of wet wipes 12 in the stack 10 has increased making it more difficult for the user to locate and grasp the leading end edge 14 of the top wet wipe with one hand to dispense the wet wipe 12.

The present invention is directed at solving the stability and dispensing problems related to such conventional stacks of wet wipes. As representatively illustrated in FIGS. 2–4, the present invention includes a plurality of individual wet wipes, as generally indicated at 22, which are individually folded and arranged in a stacked configuration to provide a stack of folded wet wipes 20. The stack of wet wipes 20 can comprise any suitable number of individually folded wet wipes 22 stacked vertically one on top of each other. For example, the stack of folded wet wipes 20 of the present invention may include at least about 5 wet wipes and desirably from about 16 to about 320 individually folded wet wipes.

Materials suitable for the wet wipes 22 of the present invention are well known to those skilled in the art. The wet wipes 22 can be made from any material suitable for use as a moist wipe, including meltblown, coform, air-laid, bonded-carded web materials, hydroentangled materials and the like and can comprise synthetic or natural fibers or combinations thereof. The wet wipes 22 may have a basis weight of from about 25 to about 120 grams per square meter and desirably from about 40 to about 90 grams per square meter. In a particular aspect, the wet wipes 22 comprise a coform basesheet of polymeric microfibers and cellulosic fibers having a basis weight of from about 60 to about 80 grams per square meter and desirably about 75 grams per square meter. Such coform basesheets are manufactured generally as described in U.S. Pat. No. 4,100,324 to Anderson et al. which issued Jul. 11, 1978, and which is herein incorporated by reference.

Typically, such coform basesheets comprise a gas-formed matrix of thermoplastic polymeric meltblown microfibers, such as, for example, polypropylene microfibers, and cellulosic fibers, such as, for example, wood pulp fibers. The relative percentages of the polymeric microfibers and cellulosic fibers in the coform basesheet can vary over a wide range depending on the desired characteristics of the wet wipes. For example, the coform basesheet may comprise from about 20 to about 100 weight percent, desirably from about 20 to about 60 weight percent, and more desirably from about 30 to about 40 weight percent of polymeric microfibers based on the dry weight of the coform basesheet being used to provide the wet wipes. Alternatively, the wet wipes 22 can be made from a meltblown sheet of polymeric microfibers having a basis weight of from about 25 to about 120 grams per square meter.

The stack of folded wet wipes 20 and each individual wet wipe 22 of the different aspects of the present invention contain a liquid which can be any solution which can be absorbed into the wet wipes 22. The liquid contained within the wet wipes 22 may include any suitable components which provide the desired wiping properties. For example, the components may include water, emollients, surfactants, preservatives, chelating agents, pH buffers or combinations thereof. The liquid may also contain lotions and/or medicaments. The amount of liquid contained within each wet wipe 22 may vary depending upon the type of material being used to provide the wet wipe 22, the type of liquid being used, the type of container being used to store the stack of wet wipes 20, and the desired end use of the wet wipe 22. Generally, each wet wipe 22 can contain from about 150 to about 600 weight percent and desirably from about 250 to about 450 weight percent liquid based on the dry weight of the wipe for improved-wiping. In a particular aspect wherein the wet wipe 22 is made from a coform material comprising from about 30 to about 40 weight percent polymeric microfibers based on the dry weight of the wipe, the amount of liquid contained within the wet wipe 22 is from about 300 to about 400 weight percent and desirably about 330 weight percent based on the dry weight of the wet wipe 22.

Figure 2:
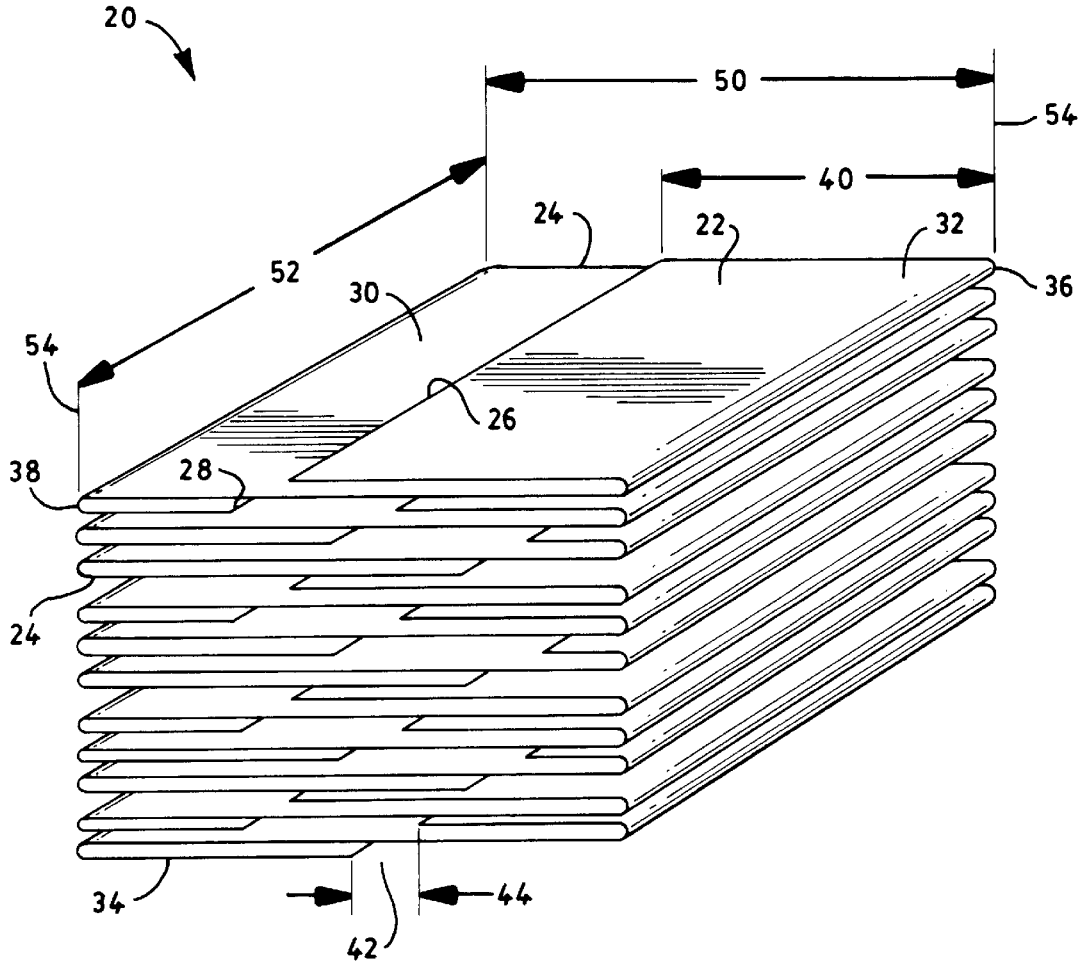
FIG. 2 representatively shows a perspective view of an example of a stack of folded wet wipes according to the present invention wherein each individual wet wipe is arranged in a z-folded configuration and wherein the location of the end edges of each folded wet wipe is selectively varied throughout the stack.

Accordingly, the stack of folded wet wipes 20, as representatively illustrated in FIG. 2, may include from about 150 to about 600 weight percent, desirably from about 250 to about 450 weight percent, and more desirably from about 300 to about 400 weight percent of the liquid based on the dry weight of the stack of wet wipes 20. If the amount of liquid is less than the above-identified range, the wet wipe may be too dry and may not adequately perform. If the amount of liquid is greater than the above-identified range, the wet wipe may be oversaturated and soggy and the liquid may pool in the bottom of the container.

Figure 3:
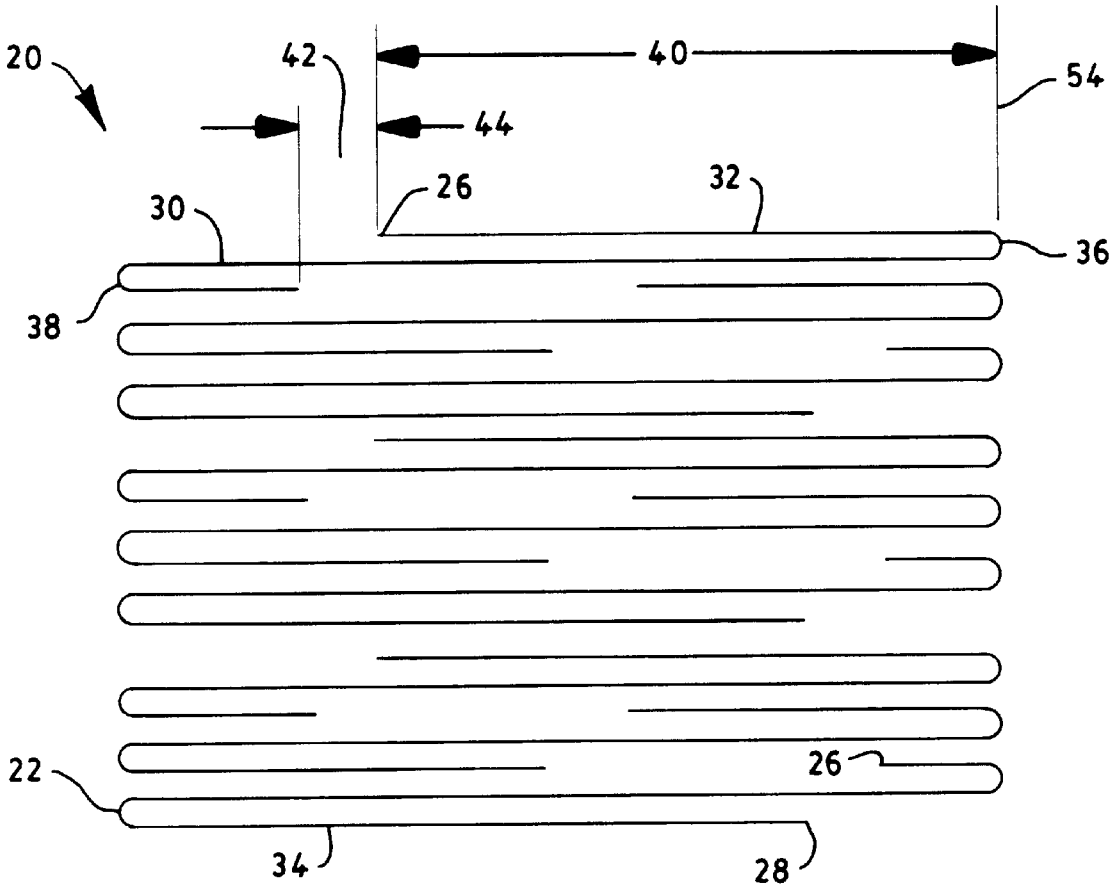
FIG. 3 representatively shows a side elevational view of the stack of folded wet wipes representatively illustrated in FIG. 2.
Figure 4:
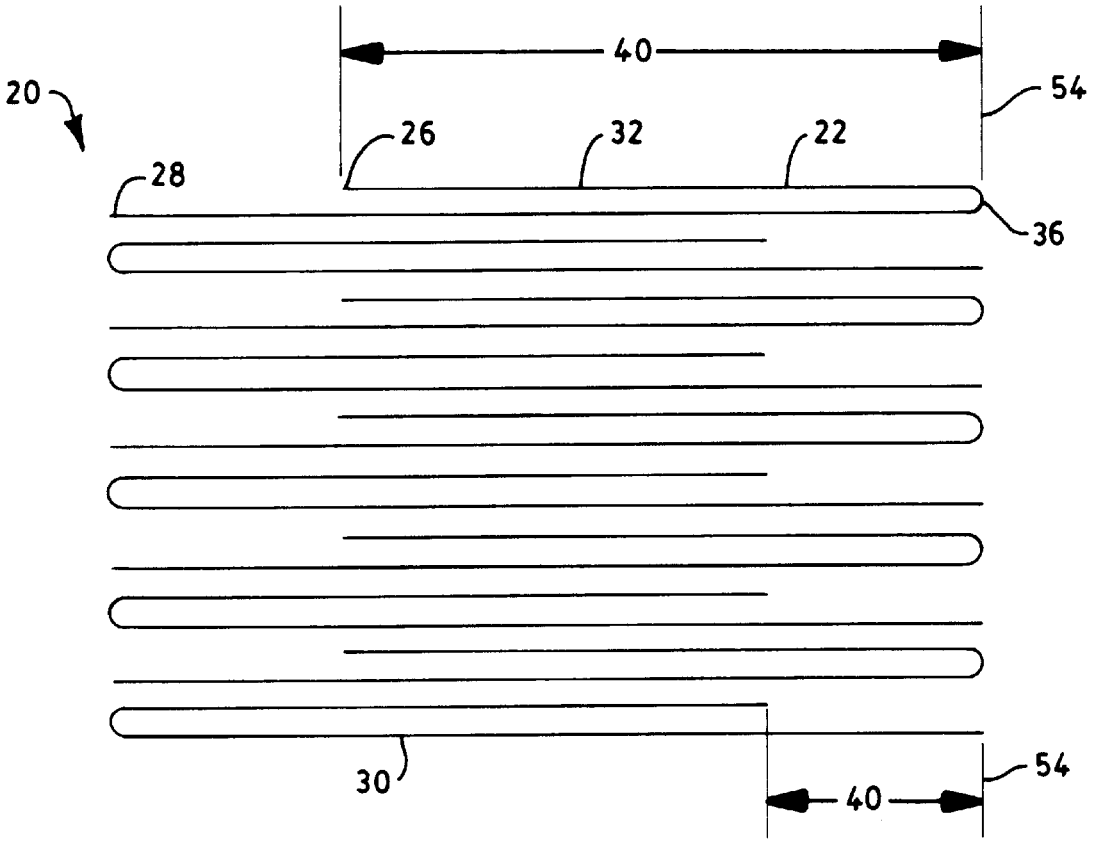
FIG. 4 representatively shows a side elevational view of another example of a stack of folded wet wipes according to the present invention wherein each individual wet wipe is arranged in a c-folded configuration and wherein the location of the leading end edge of each folded wet wipe is selectively varied throughout the stack.

As representatively illustrated in FIGS. 2–4, each wet wipe 22 in the stack of folded wipes 20 is generally rectangular in shape and defines a pair of opposite side edges 24 and a pair of opposite end edges 26 and 28 which may be referred to as a leading end edge 26 and a trailing end edge 28. The leading end edge 26 of each wet wipe 22 is typically positioned to be grasped by a user to facilitate a dispensing of the wet wipe 22 from the stack of wet wipes 20. Each wet wipe 22 defines an unfolded width and an unfolded length. The wet wipe 22 may have any suitable unfolded width and length. For example, the wet wipe 22 may have an unfolded length of from about 2.0 to about 80.0 centimeters and desirably from about 10.0 to about 25.0 centimeters and an unfolded width of from about 2.0 to about 80.0 centimeters and desirably from about 10.0 to about 45.0 centimeters.

Each individual wet wipe 22 is arranged in a folded configuration. Such folded configurations are well known to those skilled in the art and include c-folded, z-folded, quarter-folded configurations and the like. For example, as representatively illustrated in FIGS. 2 and 3, each individual wet wipe 22 may be arranged in a z-folded configuration. Alternatively, each wet wipe 22 may be arranged in a c-folded configuration as representatively illustrated in FIG. 4. Each wet wipe 22 may also be interfolded with the wet wipes-immediately above and below in the stack of wet wipes 20.

As representatively illustrated in FIG. 2, the stack of folded wet wipes 20 has a width 50 and a length 52. The width 50 and length 52 of the stack of wet wipes 20 generally refers to the as-folded width and length of the individual wet wipes 22. The stack of wet wipes 20 may have any suitable width 50 and length 52. For example, the stack of wet wipes 20 may have a width 50 of from about 2.0 to about 80.0 centimeters and desirably from about 10.0 to about 25.0 centimeters and a length 52 of from about 2.0 to about 40.0 centimeters and desirably from about 7.0 to about 14.0 centimeters. Typically, each wet wipe 22 is folded about it's width and arranged in a stacked configuration as representatively illustrated in FIGS. 2–4. Accordingly, the length 52 of the stack of folded wet wipes 20 generally corresponds to the unfolded length of the wet wipes 22 in the stack 20. One skilled in the art will recognize that if each wet wipe 22 is also folded about it's length, the length 52 of the stack of wet wipes 20 may not correspond to the unfolded length of the wet wipe 22.

Applicants have discovered that a more stable and aesthetically pleasing stack of wet wipes can be achieved by controlling the dimensional tolerances of each individual wet wipe 22 in the stack of wet wipes 20. For example, as illustrated in FIGS. 2 and 3, Applicants have discovered that by controlling the unfolded width, folded width 50, and length 52 of each wet wipe 22 to close tolerances and controlling the stacking of the wet wipes on top of each other, the resulting stack of wet wipes 20 has substantially planar side margins 54. Such planar side margins 54 provide a more stable stack which has a substantially rectangular configuration. Such stacks are easier to package and more aesthetically pleasing. Desirably, the dimensional tolerances of each individual wet wipe 22 are controlled such that the folded width 50 and unfolded width of the wet wipes 22 in the stack of wet wipes 20 define a standard deviation of less than about 2.5 millimeters, more desirably less than about 2.0 millimeters, and even more desirably less than about 1.6 millimeters. If the stack of wet wipes has dimensional standard deviations greater than those set forth above, the stack will not have substantially planar side margins 54 and may result in an unstable stack which is more difficult to package and use.

When the wet wipes 22 are arranged in a folded configuration, such as the z-folded configuration of FIGS. 2 and 3 or the c-folded configuration of FIG. 4, each wet wipe 22 defines a central portion 30 and a top flap portion 32. The top flap portion 32 is connected to the central portion 30 along a first fold line 36 and is folded over upon the central portion 30 before the wet wipe 22 is placed in the stack of wet wipes 20. The top flap portion 32 is generally shorter in length than the central portion 30 such that it does not cover the entire central portion 30. The top flap portion 32 includes the leading end edge 26 of the wet wipe 22 which is adapted to facilitate the dispensing of the wet wipe 22 from the stack of wet wipes 20. If each wet wipe 22 is arranged in a z-folded configuration as illustrated in FIGS. 2 and 3, the wet wipe 22 also defines a bottom flap portion 34. In such a configuration, the bottom flap portion 34 includes the opposite or trailing end edge 28 of the wet wipe 22. The bottom flap portion 34 is folded about a second fold line 38 under the central portion 30 of the wet wipe 22.

As described above, conventional stacks of wet wipes which have been c-folded have typically had a ridge located along the leading end edge of the wet wipes due to the extra thickness of material. Moreover, conventional stacks of wet wipes which have been z-folded have had either a ridge or a recess depending upon whether the leading and trailing end edges of the wet wipes in the stack were configured to overlap or provide a gap. Such a ridge or a recess becomes a more evident problem when the dimensional tolerances and manufacturing of the wet wipes are controlled to provide consistently folded wet wipes since the end edges of the wet wipes are more likely to be positioned on top of each other in the stack. The ridge or recess also becomes more defined as the gap or overlap between the end edges of the wet wipes increases.

Applicants have discovered that the formation of a ridge or recess in the stack of folded wet wipes 20 can be prevented by selectively varying the location of the leading end edge 26 of each wet wipe 22 in the stack 20. For example, as representatively illustrated in FIGS. 2–4, the top flap length, or the distance 40 from the leading end edge 26 of each wet wipe 22 to the first fold line 36 of the wet wipe 22 or the side margin 54 of the stack 20, is selectively varied throughout the stack 20. As used herein, reference to the side margin 54 of the stack of wet wipes 20 refers to the outermost edges of the stack of wet wipes 20 which may be different than the fold lines 36 and 38 of an individual wet wipe 22 if the wet wipes in the stack are not perfectly aligned one on top of each other. For example, the top flap length 40 of the wet wipes 22 in the stack of wet wipes 20 may be selectively varied between about 10 and about 70 millimeters and desirably between about 40 and about 60 millimeters to prevent the formation of a ridge or recess in the stack 20.

Desirably, the top flap length 40, or distance from the leading end edge 26 of each wet wipe 22 to the first fold line 36 of the wet wipe 22 or the side margin 54 of the stack of wet wipes 20, varies by at least about 10 millimeters and more desirably by at least about 15 millimeters throughout the stack of wet wipes 20 for improved dispensing. Moreover, in a particular aspect, the top flap length 40 of the wet wipe 22 varies by at least about 5 millimeters and desirably by at least about 8 millimeters between adjacent wet wipes 22 in the stack of wet wipes for improved dispensing.

Further, the top flap length 40 of the wet wipes 22 in the stack of wet wipes 20 desirably defines a standard deviation for the stack of at least about 3.0 millimeters, more desirably at least about 4.0 millimeters, and even more desirably at least about 4.25 millimeters. If the top flap length 40 does not vary by a sufficient amount, the top surface of the resulting stack of folded wet wipes may still have a deep recess or large ridge which adversely affects the dispensing of each wet wipe. As a result, stacks of folded wet wipes 20 according to the present invention are configured to have substantially planar side margins and top surfaces which provide stable, aesthetically pleasing stacks with improved dispensing. The substantially planar top surface allows the user to easily frictionally drag one or more fingers across the stack to peel back the leading end edge of the top wet wipe in the stack and dispense the wipe.

In a particular aspect, the stack of wet wipes of the present invention includes at least about 20 folded wet wipes wherein the unfolded width of the wet wipes defines a standard deviation of less than about 2.5 millimeters and desirably less than about 2.0 millimeters, the folded width 50 of the wet wipes defines a standard deviation of less than about 2.5 millimeters and desirably less than about 2.0 millimeters, and the top flap length 40 of the wet wipes defines a standard deviation of at least about 3.0 millimeters and desirably at least about 4.0 millimeters to provide improved dispensing and stability.

The location of the leading end edge 26 relative to the first fold line 36 and the side margin 54 can be varied in any manner which provides the desired stack of wet wipes. For example, the location of the leading end edge 26 may be randomly varied throughout the stack 20 or may be varied in any desired pattern. In a particular aspect, the location of the leading end edge 26 and the corresponding distance 40 between the leading end edge 26 and the first fold line 36 or the side margin 54 is selectively varied in a repeating pattern for improved processing. For example, the location of the leading end edge 26 may be varied in a pattern which repeats itself every 2 wet wipes or more.

If the stack of wet wipes 20 of the present invention is arranged in a z-folded configuration as representatively illustrated in FIGS. 2 and 3, the leading end edge 26 and trailing end edge 28 of each wet wipe may be configured to provide a gap 42. Typically, the gap 42 defines a gap distance 44 of from about 0 to about 15 millimeters. The existence of such a gap 42 has led to a recess in conventional stacks of wet wipes. In particular, Applicants have discovered that the recess becomes more evident when the wet wipes 22 in the stack define an average gap distance 44 of at least about 1.5 millimeters and even more evident when the wet wipes define an average gap distance of at least about 2.0 millimeters. However, in the different aspects of the present invention such a recess is prevented by selectively varying the location of the leading end edge 26 of each wet wipe 22 throughout the stack of wet wipes 20. In a particular aspect, wherein the wet wipes 22 in the stack of wet wipes 20 are z-folded and define an average gap distance 44 of at least about 1.5 millimeters, Applicants have discovered that varying the top flap length 40 of the wet wipes in the stack such that the top flap length of the wet wipes defines a standard deviation of at least about 4.0 millimeters provides a stack with improved dispensing and stability.

Applicants have discovered that, when compared to conventional stacks of wet wipes which have leading end edges vertically aligned, the stacks of wet wipes according to the different aspects of the present invention have improved dispensing by providing a substantially planar top surface to the stack. Thus, the stacks of wet wipes of the present invention allow the user to more easily recognize and peel back the leading end edge 26 of the wet wipe 22. Moreover, the varying location of the end edges 26 and 28 of the wet wipes 22 throughout the stack of wet wipes of the present invention is particularly important as the number of wet wipes 22 in the stack of wet wipes increases. As the number of wet wipes 22 in the stack increases, the depth of the recess or height of the ridge which would exist if the edges were vertically aligned in the stack would also increase. Applicants have discovered that the stacks of wet wipes according to the present invention provide particularly improved dispensing when the number of wet wipes 22 in the stack of wet wipes 20 is at least about 20, more improved dispensing when the number of wet wipes 22 in the stack of wet wipes 20 is at least about 40, and even more improved dispensing when the number of wet wipes 22 in the stack of wet wipes 20 is at least about 60.

As representatively illustrated In FIGS. 2–4, the stacks of wet wipes 20 of the different aspects of the present invention may be manufactured using several different processes well known to those skilled in the art. The particular method and sequence of steps described herein is not a limitation to the present invention, but is disclosed only as one method of producing a wet wipe and stack of wet wipes. Initially, a supply roll of the material being converted into the wet wipes 22 is unwound to provide a continuously moving web of material. The web of material is saturated or otherwise impregnated with a liquid, such as those described above, by any suitable means such as spraying, dipping, or the like as are well known to those skilled in the art. In a particular aspect, the web of material is passed over several perforated tubes which exude the liquid into the material. The add-on amount of liquid can be any amount which produces the desired wet wipe 22 and stack of wet wipes 20.

The web of material is slit in the machine direction into multiple ribbons, each of which may be folded into the type of fold desired for the individual-wet wipe 22. The web of material is slit using a cutter as are well known to those skilled in the art. For example, the web of material can be slit into eight individual ribbons. The ribbons of material are then be folded into a folded configuration. For example, each ribbon of material may define a central portion and a top flap portion which is connected to and folded over upon the central portion along a first fold line. The top flap portion includes the leading end edge of the wet wipe which is configured to be grasped by the user when dispensing the wet wipe. Each ribbon of material may also define a bottom flap portion which is connected to and folded under the central portion along a second fold line to provide a z-folded configuration. The folding of each ribbon is controlled to selectively vary the location of the leading end edge of each wet wipe relative to the fold lines. The folding of each ribbon can be controlled by any suitable means known to those skilled in the art. For example, the ribbons may pass over turn bars which are oriented to provide the variable folding.

Each folded ribbon may then be combined, one ribbon on top of the other, with the other seven folded ribbons from the same web of material to form a continuous "sausage." The sausage is then cut into "clips" of eight wet wipes apiece and the clips of wet wipes are arranged in a stacked configuration to form at least one stack of folded wet wipes 20, as representatively illustrated in FIG. 2. The number of clips in a stack depends on the desired number of stacks and the number of wet wipes 22 in the final package. For example, for an 80-count package having one stack, ten clips of eight wet wipes apiece would be required to form a single stack of 80 wet wipes.

After the stack of wet wipes 20, as representatively illustrated in FIG. 2, is properly configured, at least one stack of folded wet wipes 20 may be placed in the interior of a container, such as a plastic tub, to provide a package of wet wipes. As representatively illustrated in FIG. 5, the package of wet wipes, as generally indicated at 60, includes a container 62 which defines an interior 64 and which includes a reclosable top 66. The container 62 provides a substantially hermetically sealed environment for at least one stack of wet wipes 20 to minimize the escape of any liquid therefrom. The reclosable top 66 can be selectively opened and closed by the user to provide access to the stack of wet wipes 20.

At least one stack of wet wipes 20 of the different aspects of the present invention, as representatively illustrated in FIGS. 2–4, is inserted into the interior 64 of the container 62 to provide the package of wet wipes 60. Any suitable number of wet wipes 22 may be included in the stack of wet wipes 20 to provide the desired number of wet wipes in the package 60. The interior 64 of the container 62 has a width and a length which are substantially equal to the width 50 and length 52 of the stack of wet wipes 20 as representatively illustrated in FIG. 2. When packaged in this configuration, it is difficult for the user to grasp each wet wipe 22 along it's side edges 24 or adjacent the fold lines 36 and 38 to facilitate a dispensing of each wet wipe 22 from the package of wet wipes 60. Accordingly, the user typically grasps the leading end edge 26 of each wet wipe 22 to dispense the wet wipe 22 from the container 62.

Figure 5:
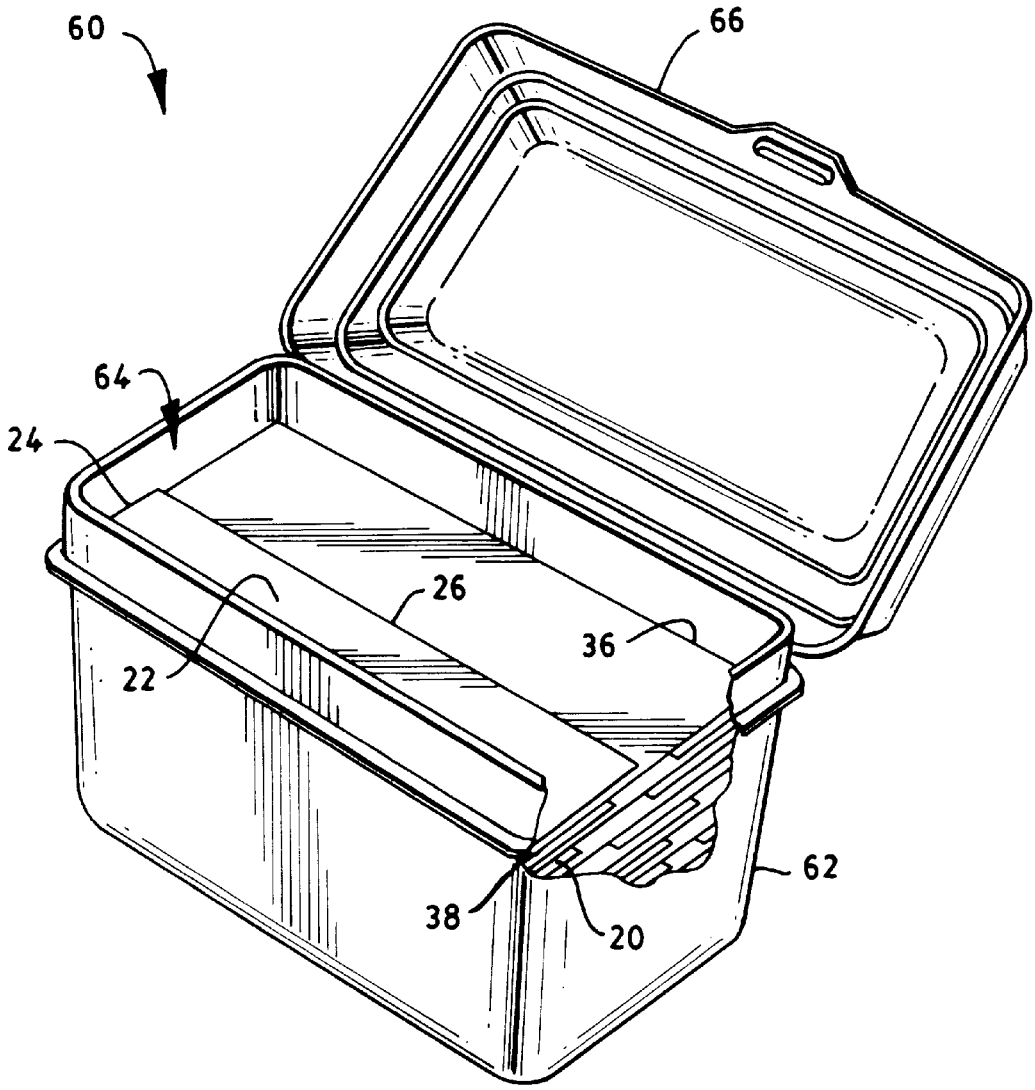
FIG. 5 representatively shows a perspective view of a package containing a stack of folded wet wipes according to the present invention.

In use, the user can open the package of wet wipes 60, as representatively illustrated in FIG. 5, by lifting the reclosable top 66 of the container 62. After opening the reclosable top 66, the user can selectively drag one or more fingers across the top of the stack of wet wipes 20 to peelingly lift the leading end edge 26 of the top wet wipe 22 from the stack of wet wipes 20. As such, the package of wet wipes 60 of the present invention can be opened and the wet wipe 22 can be easily dispensed with one hand. After dispensing one or more wet wipes 22, the user can close the reclosable top 66 to minimize the escape of any liquid. As long as the user maintains the reclosable top 66 in the closed position when not using the wet wipes 22, the wet wipes 22 should retain the desired amount of liquid.

Accordingly, the different aspects of the present invention can advantageously provide stacks of wet wipes which, when compared to conventional stacks of wet wipes, are more stable and have more planar side margins and top surfaces. Such stacks have improved dispensing of each wet wipe from the stack of wet wipes. Thus, the stack of wet wipes of the present invention provide wet wipes which are reliably and easily dispensed by one hand of the user to allow the user the freedom to use their other hand for other purposes. Such stacks of wet wipes can advantageously be used for baby wipes, hand wipes, face wipes, cosmetic wipes, household wipes, industrial wipes and the like.

EXAMPLES

The following examples are presented to provide a more detailed understanding of the invention. The particular materials and parameters are exemplary and are not intended to limit the scope of the invention.

Example 1

Five (5) containers of Kleenex® Huggies® Baby Wipes which were commercially available from Kimberly-Clark Corporation, a business having offices located in Neenah, Wisconsin were obtained. Each tub included a stack of 80 folded wet wipes which were arranged in a single, stacked configuration. Each wet wipe comprised a coform basesheet having about 65 weight percent cellulosic fibers and 35 weight percent polypropylene microfibers based on the dry weight of the basesheet. The wet wipes within each stack included about 330 weight percent liquid based on the dry weight of the basesheet. The liquid included water, emollients, surfactants, preservatives, pH buffers, chelating agents, or combinations thereof. The individual wet wipes 22 were z-folded and arranged in a stack of 80 wet wipes as representatively illustrated in FIGS. 2 and 3.

As representatively illustrated in FIGS. 2 and 3, the location of the leading end edge 26 of each z-folded wet wipe relative to the first fold line 36 and side margin 54 of the stack of wet wipes was selectively varied throughout the stack of wet wipes in a repeating pattern. A series of measurements on the top 40 wet wipes in each stack were recorded. The distance 40 from the leading end edge 26 to the first fold line 36, or the top flap length, was recorded for each wet wipe. In addition, the unfolded width, folded width 50 and gap distance 44, as representatively illustrated in FIGS. 2 and 3, were also recorded. The top flap length of the wet wipes in the stacks varied between 45 and 60 millimeters with an average standard deviation of 4.46 millimeters for the five stacks of wet wipes. The wet wipes had an average unfolded width of 191 millimeters with an average standard deviation of 1.09 millimeters for the five stacks of wet wipes. The wet wipes in the stacks also had an average folded width 50 of 96.7 millimeters with an average standard deviation of 1.55 millimeters, and an average gap distance 44 of 2.3 millimeters. The data is also recorded in Tables 1 and 2.

Comparative Example 1

Five (5) containers of Baby Fresh Gentle Touch Baby Wipes which were commercially available from Scott Paper Co., a business having offices located in Boca Raton, Fla. were obtained. Each container included 84 folded wet wipes which were arranged in a single, stacked configuration. The individual wet wipes were z-folded and arranged in a single stack.

The top 40 wet wipes from each container were subjected to the same measurements taken in Example 1. The top flap length of the wet wipes in the stacks varied between 50 and 61 millimeters with an average standard deviation of 3.78 millimeters for each stack of wet wipes. The wet wipes had an average unfolded width of 212 millimeters with an average standard deviation of 5.32 millimeters for the five stacks of wet wipes. The wet wipes in the stacks also had an average folded width 50 of 109.5 millimeters with an average standard deviation of 3.17 millimeters, and an average gap distance 44 of 13.5 millimeters. The data is also recorded in Tables 1 and 2.

Comparative Example 2

Five (5) containers of Baby Fresh—Original Baby Wipes which were commercially available from Scott Paper Co., a business having offices located in Boca Raton, Fla. were obtained. Each container included 84 folded wet wipes which were arranged in a single, stacked configuration. The individual wet wipes were z-folded and arranged in a single stack.

The top 40 wet wipes from each container were subjected to the same measurements taken in Example 1. The distance 40 from the leading end edge 26 to the first fold line 36 throughout the wet wipes in the stacks varied between 57 and 63 millimeters with an average standard deviation of 1.61 millimeters for each stack of wet wipes. The wet wipes had an average unfolded width of 217 millimeters with an average standard deviation of 2.53 millimeters for the five stacks of wet wipes. The wet wipes in the stacks also had an average folded width 50 of 112.7 millimeters with an average standard deviation of 1.28 millimeters, and an average gap distance 44 of 7.9 millimeters. The data is also recorded in Tables 1 and 2.

Comparative Example 3

Five (5) containers of Pampers Baby Wipes which were commercially available from The Procter & Gamble Co., a business having offices located in Cincinnati, Ohio, were obtained from Europe. Each container included 80 folded wet wipes which were arranged in a single, stacked configuration. The individual wet wipes were z-folded and arranged in a single stack.

The top 40 wet wipes from each container were subjected to the same measurements taken in Example 1. The distance

40 from the leading end edge 26 to the first fold line 36 throughout the wet wipes in the stacks from each container varied between 59 and 39 millimeters with an average standard deviation of 3.85 millimeters for each stack of wet wipes. The wet wipes had an average unfolded width of 206 millimeters with an average standard deviation of 10.3 millimeters for the five stacks of wet wipes. The wet wipes in the stacks also had an average folded width 50 of 102.0 millimeters with an average standard deviation of 1.85 millimeters, and an average gap distance 44 of 1.59 millimeters. The data is also recorded in Tables 1 and 2.

Comparative Example 4

Five (5) containers of Chubs Baby Wipes which were commercially available from Reckitt & Coleman, a business having offices located in Montvale, N.J., were obtained. Each container included 80 folded wet wipes which were arranged in a single, stacked configuration. The individual wet wipes were z-folded and arranged in a single stack.

The top 40 wet wipes from each container were subjected to the same measurements taken in Example 1. The distance 40 from the leading end edge 26 to the first fold line 36 throughout the wet wipes in the stacks varied between 40 and 66 millimeters with an average standard deviation of 7.09 millimeters for each stack of wet wipes. The wet wipes had an average unfolded width of 194 millimeters with an average standard deviation of 3.46 millimeters for the five stacks of wet wipes. The wet wipes in the stacks also had an average folded width 50 of 93.6 millimeters with an average standard deviation of 2.71 millimeters, and an average gap distance 44 of −6.6 millimeters. The gap distance is negative because the end edges overlapped. The data is also recorded in Tables 1 and 2.

Comparative Example 5

Five (5) containers of Suave Baby Wipes which were commercially available from Helene Curtis, a business having offices located in Chicago, Ill., were obtained. Each container included 80 folded wet wipes which were arranged in a single, stacked configuration. The individual wet wipes were z-folded and arranged in a single stack.

The top 40 wet wipes from each container were subjected to the same measurements taken in Example 1. The distance 40 from the leading end edge 26 to the first fold line 36 throughout the wet wipes in the stacks varied between 47 and 75 millimeters with an average standard deviation of 9.01 millimeters for each stack of wet wipes. The wet wipes had an average unfolded width of 205 millimeters with an average standard deviation of 1.81 millimeters for the five stacks of wet wipes. The wet wipes in the stacks also had an average folded width 50 of 102.9 millimeters with an average standard deviation of 4.74 millimeters, and an average gap distance 44 of 0.18 millimeters. The data is also recorded in Tables 1 and 2.

TABLE 1

| | Top Flag Length | | Avg. Folded | Avg. Unfolded | |
|---|---|---|---|---|---|
| | min. (mm) | max. (mm) | Width (mm) | Width (mm) | Avg. Gap (mm) |
| Ex. 1 | 45 | 60 | 96.7 | 191 | 2.3 |
| C. Ex. 1 | 50 | 61 | 109.5 | 212 | 13.5 |
| C. Ex. 2 | 57 | 63 | 112.7 | 217 | 7.9 |
| C. Ex. 3 | 39 | 59 | 102.0 | 206 | 1.6 |

TABLE 1-continued

| | Top Flag Length | | Avg. Folded | Avg. Unfolded | |
|---|---|---|---|---|---|
| | min. (mm) | max. (mm) | Width (mm) | Width (mm) | Avg. Gap (mm) |
| C. Ex. 4 | 40 | 66 | 93.6 | 194 | −6.6 |
| C. Ex. 5 | 47 | 75 | 102.9 | 205 | 0.18 |

TABLE 2

| | Top Flag Length avg. stan. dev. (mm) | Folded Width avg. stan. dev. (mm) | Unfolded Width avg. stan. dev. (mm) |
|---|---|---|---|
| Ex. 1 | 4.46 | 1.55 | 1.09 |
| C. Ex. 1 | 3.78 | 3.17 | 5.32 |
| C. Ex. 2 | 1.61 | 1.28 | 2.53 |
| C. Ex. 3 | 3.85 | 1.85 | 10.30 |
| C. Ex. 4 | 7.09 | 2.71 | 3.46 |
| C. Ex. 5 | 9.01 | 4.74 | 1.81 |

The Example shows how the stacks of folded wet wipes of the present invention include wet wipes which are manufactured such that the unfolded width and folded width of the wet wipes in each stack are very consistent when compared to those in the comparative examples. Such close manufacturing tolerances results in stacks of wet wipes which are substantially rectangular in configuration, stable, and more aesthetically pleasing. The Example further shows how the location of the end edges of the individually folded wet wipes are selectively varied a predetermined amount throughout the stack to eliminate the problem of a recess or ridge forming in the stack. The variation of the location of the end edges is particularly important since the unfolded width and folded width of each wet wipe are very consistent and the gap between the end edges of each wet wipe is relatively large. In addition, the amount of variation in the stacks of the present invention is substantially more than any variation which may occur due to inherent processing conditions.

While the invention has been described in detail with respect to the specific aspects thereof, it will be appreciated that those skilled in the art, upon attaining an understanding of the foregoing, may readily conceive of alterations to, variations of, and equivalents to these aspects. Accordingly, the scope of the present invention should be assessed as that of the appended claims and any equivalents thereto.

What is claimed is:

1. A method of providing a stack of individually folded wet wipes comprising:

a) providing a continuously moving web of material;

b) folding said web of material along a first fold line to define a central portion and a top flap portion which includes a leading end edge which is folded over upon said central portion;

c) cutting said folded web of material to provide a plurality of generally rectangular, folded over wet wipes, each of said wet wipes defining an unfolded width, a folded width, and a top flap length, wherein said unfolded width of said wet wipes in said stack defines a standard deviation of less than about 2.5 millimeters and said folded width of said wet wipes in said stack defines a standard deviation of less than about 2.5 millimeters; and d) arranging each of said folded over wet wipes in a substantially rectangular, stacked configuration to form said stack of wet wipes wherein said folding is controlled to selectively vary said top flap length of each of said wet wipes throughout said stack and wherein said top flap length of said wet wipes in said stack defines a standard deviation of at least about 3.0 millimeters.

2. The method of claim 1 wherein said top flap length of said wet wipes in said stack defines a standard deviation of at least about 4.0 millimeters.

3. The method of claim 1 wherein said top flap length of said wet wipes in said stack defines a standard deviation of at least about 4.25 millimeters.

4. The method of claim 1 wherein said top flap length of said wet wipes in said stack varies by at least about 10 millimeters throughout said stack.

5. The method of claim 1 wherein said folding is controlled to vary said top flap length of each of said wet wipes in a repeating pattern throughout said stack of wet wipes.

6. A method for providing a substantially rectangular stack of z-folded wet wipes which are easily dispensed, said method comprising the steps of:

a) providing a continuously moving web of material;

b) adding a liquid to the web of material;

c) slitting the web of material in a machine direction into a plurality of continuously moving ribbons of material;

d) folding each of said ribbons of material along a first fold line and a second fold line to define a plurality of continuously moving z-folded ribbons which include a central portion, a top flap portion which is connected to and folded over upon said central portion along said first fold line, and a bottom flap portion which is connected to and folded under said central portion along said second fold line, wherein said folding of each of said ribbons of material is controlled to selectively vary a length of said top flap portion;

e) arranging each of said continuously moving z-folded ribbons in a stacked configuration to provide a continuously moving stack of z-folded ribbons;

f) intermittently cutting said continuously moving stack of z-folded ribbons to provide a substack of z-folded wet wipes; and g) combining a plurality of said substacks of z-folded wet wipes to provide said stack of z-folded wet wipes wherein each of said wet wipes defines an unfolded width, a folded width, and a top flap length, and wherein said unfolded width of said wet wipes defines a standard deviation of less than about 2.5 millimeters, said folded width of said wet wipes defines a standard deviation of less than about 2.5 millimeters, and said top flap length of said wet wipes is selectively varied throughout said stack to define a standard deviation of at least about 3.0 millimeters for said stack of wet wipes.

7. The method of claim 6 wherein a gap is formed between a leading end edge and a trailing end edge of each of said wet wipes and wherein said gap defines an average gap distance of at least about 1.5 millimeters for said stack of wet wipes.

8. The method of claim 6 wherein said top flap length of said wet wipes is varied throughout said stack of wet wipes in a predetermined, repeating pattern.

9. The method of claim 6 wherein said top flap length of said wet wipes in said stack of wet wipes defines a standard deviation of at least about 4.0 millimeters.

* * * * *